US006227254B1

(12) United States Patent
Poe et al.

(10) Patent No.: US 6,227,254 B1
(45) Date of Patent: May 8, 2001

(54) METHOD AND APPARATUS FOR RECYCLING SELVAGE WARP YARNS

(75) Inventors: Robert Lee Poe; Felix McBee, Jr., both of Cartersville; Phillip Wayne Pledger, Cedartown, all of GA (US)

(73) Assignee: The Goodyear Tire & Rubber Company, Akron, OH (US)

( * ) Notice: Subject to any disclaimer, the term of this patent is extended or adjusted under 35 U.S.C. 154(b) by 0 days.

(21) Appl. No.: 09/674,569

(22) PCT Filed: May 5, 1998

(86) PCT No.: PCT/US98/09067

§ 371 Date: Oct. 27, 2000

§ 102(e) Date: Oct. 27, 2000

(87) PCT Pub. No.: WO99/57352

PCT Pub. Date: Nov. 11, 1999

(51) Int. Cl.[7] ..... D03D 47/40

(52) U.S. Cl. ..... 139/302

(58) Field of Search ..... 139/302

(56) References Cited

U.S. PATENT DOCUMENTS

| | | | | |
|---|---|---|---|---|
| 4,296,783 | * | 10/1981 | Ichimatsu | 139/302 |
| 4,498,504 | * | 2/1985 | Allen et al. | 139/302 |
| 4,513,791 | * | 4/1985 | Dillon | 139/194 |
| 5,560,400 | * | 10/1996 | Meyns et al. | 139/302 |
| 5,735,316 | * | 4/1998 | Hehle | 139/302 |

FOREIGN PATENT DOCUMENTS

| | | | |
|---|---|---|---|
| 30 25 744 | 1/1982 | (DE) | D03D/47/40 |
| 0 251 017 | 1/1988 | (EP) | D03D/47/40 |
| 2 153 250 | 5/1973 | (FR) | D03D/47/00 |

* cited by examiner

*Primary Examiner*—Andy Falik
(74) *Attorney, Agent, or Firm*—Nancy T Krawczyk

(57) ABSTRACT

A method of recycling selvage yarns in a weaving operation involves providing selvage warp yarns which are continuous. The selvage is slit after passing through the loom from the main fabric warp yarns.

3 Claims, 3 Drawing Sheets

METHOD AND APPARATUS FOR RECYCLING SELVAGE WARP YARNS

FIELD OF THE INVENTION

This invention relates to a method of recycling selvage warp yarns in a fabric weaving operation and an apparatus for carrying out the method.

BACKGROUND OF THE INVENTION

Heretofore, the selvage warp yarns that bind the fill yarns during the weaving operation were slit from the fabric warp yarns and discarded.

DE 3025744 discloses an apparatus wherein the selvage warp yarns are spaced from the main warp yarns forming the fabric. The continuous selvage warp yarns are spliced from the main fabric body after weaving, the cut warp yarns are removed, and the selvage warp yarns are returned to the weaving machine.

This invention is also directed to a method and apparatus for reducing waste by recycling the warp yarns of the selvage. The selvage warp yarns are guided in a continuous pattern through the loom, returned through a spreader means to discard the cut fill fringe yarns and recombined to go through the loom again.

SUMMARY OF THE INVENTION

In accordance with the practice of the invention, there is provided a method of recycling selvage warp yarns in a weaving operation comprised of:

a. providing a plurality of selvage warp yarns which form a continuous loop through the loom;

b. feeding the selvage warp yarns next to an outer fabric warp yarn;

c. weaving fill yarns through all of the warp yarns;

d. slitting the fill yarns between the outer fabric warp yarn and the inner selvage warp yarn;

e. passing the selvage warp yarns through a separator to allow the cut fill yarn fringe ends to dislodge from the selvage warp yarns; and f. recombining the selvage warp yarns to feed through the loom again wherein the method is characterized by:

after slitting the fill yarns between the outer fabric warp yarn and the inner selvage warp yarn, passing the cut fill yarns fringe ends and the selvage warp yarns through a shaker bar to shake the cut fill fringe yarns from the continuous selvage warp yarns.

There is also provided an apparatus for recycling the selvage warp yarns in a weaving operation comprising:

a. means for guiding a plurality of continuous selvage warp yarns into a loom;

b. a loom to weave the warp yarns with fill yarns into a fabric;

c. a slitter means for slitting the fill yarns between an innermost selvage warp yarn and an outermost main fabric warp yarn;

the apparatus being characterized by:

d. guide rollers to direct the cut selvage portion through a horn guide;

e. a shaker bar to shake the cut fill fringe yarns from the continuous selvage warp yarns; and f. a spreader bar having spaced guides for each continuous selvage warp yarn to aid in dislodging the fill fringe yarn.

DESCRIPTION OF THE INVENTION

Figure 1:
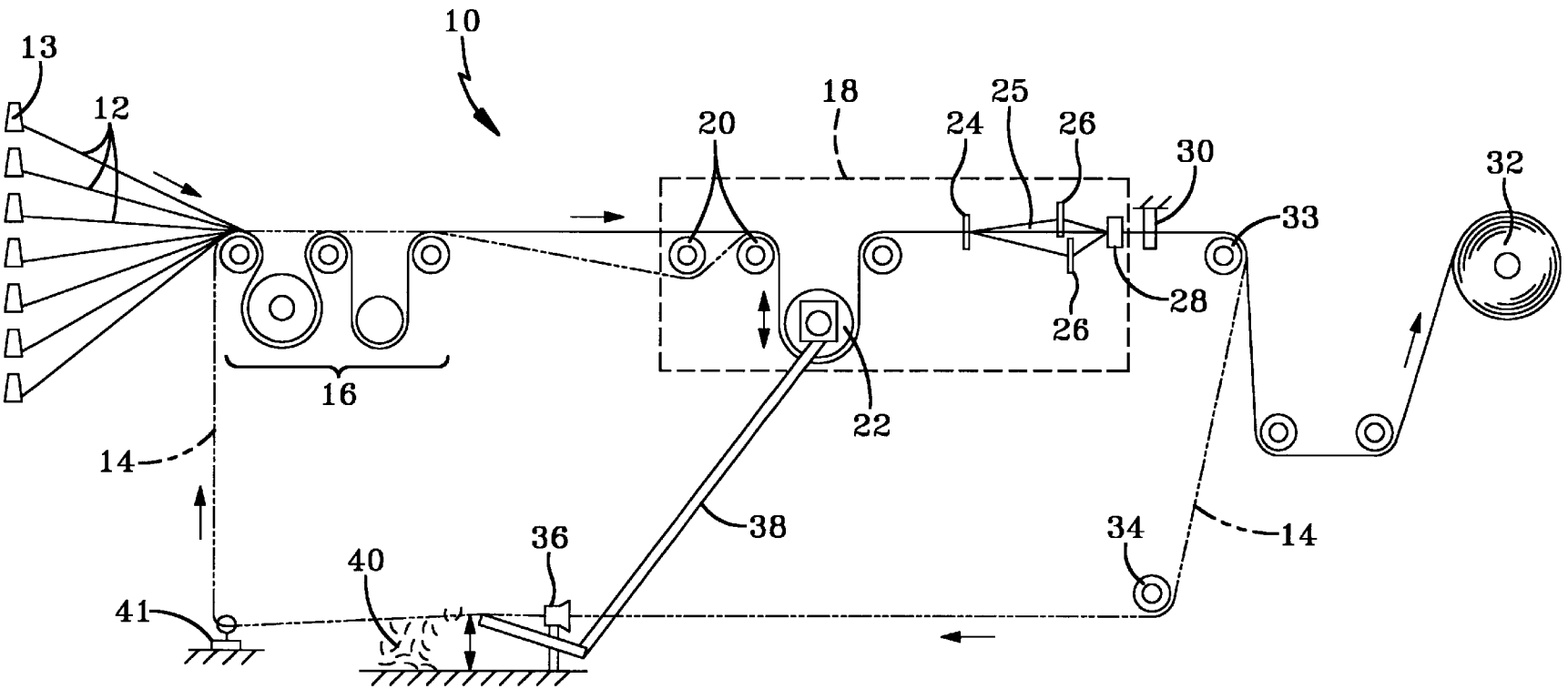
FIG. 1 is a schematic elevational view of the weaving operation of the invention.
Figure 2:
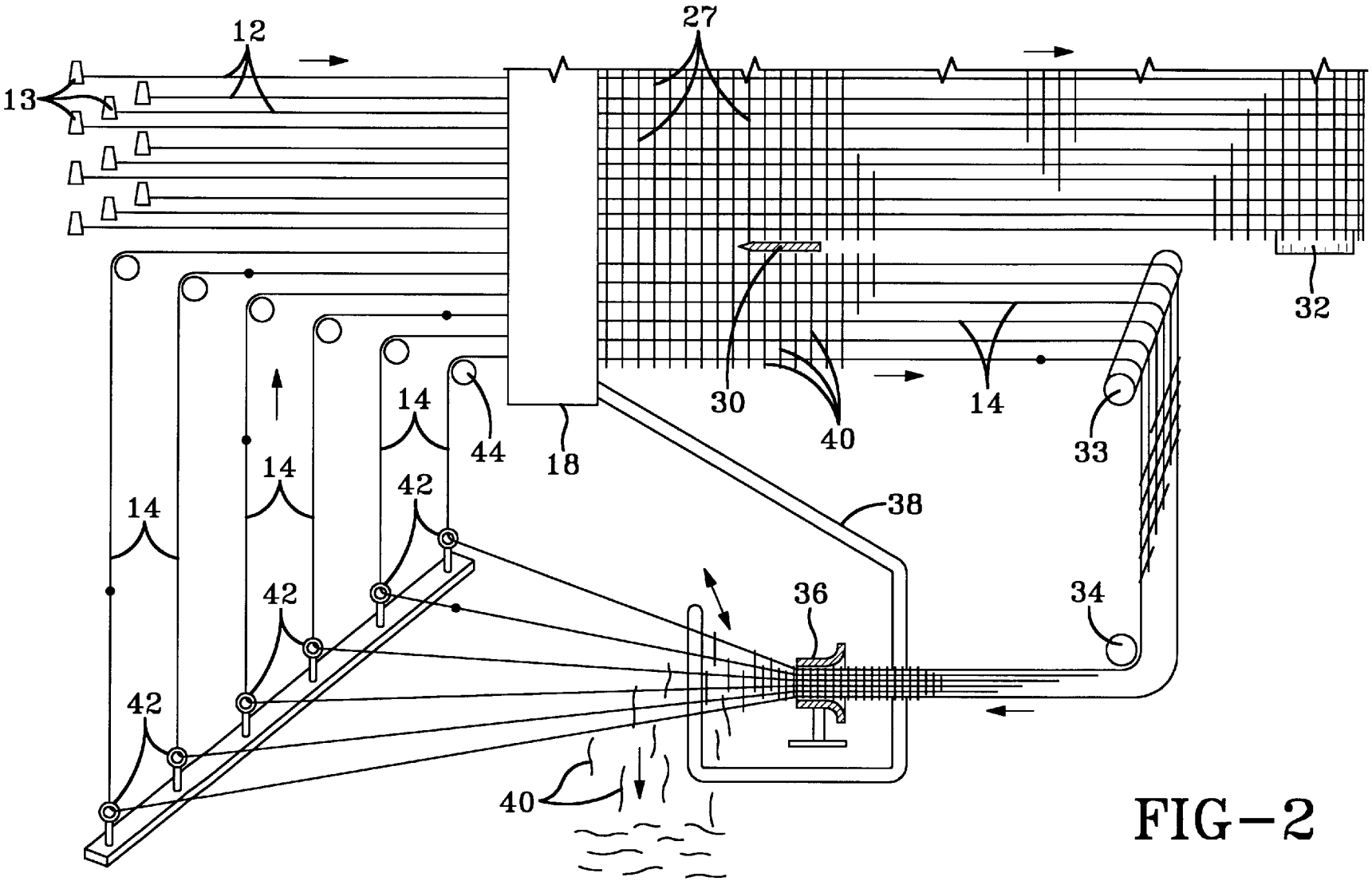
FIG. 2 is a schematic plan view of the weaving operation of the invention.
Figure 3:
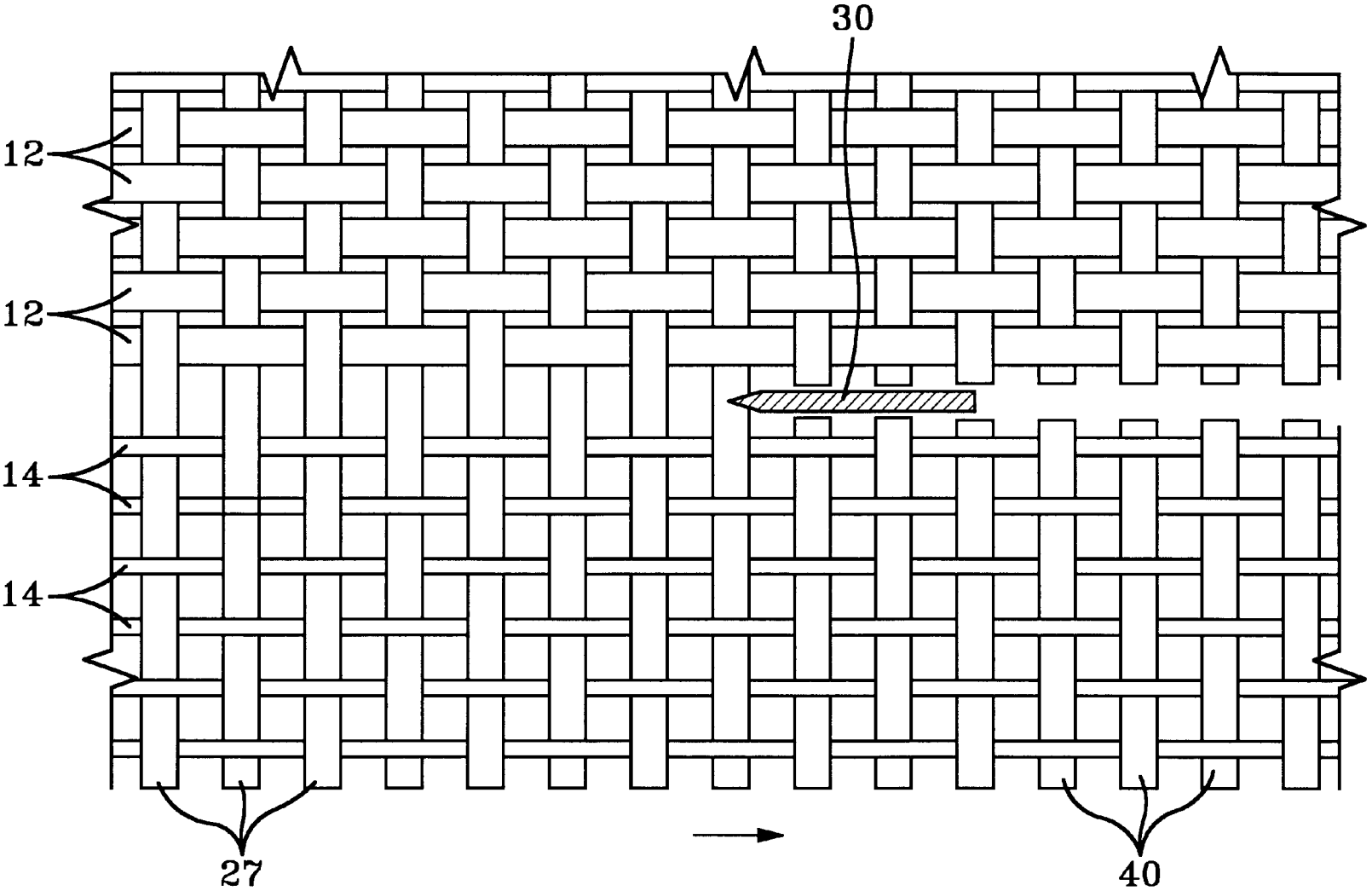
FIG. 3 is an enlarged view of the splitting operation of the invention.

A fabric weaving system is shown generally at 10 where the main fabric warp yarns 12 are fed from creels 13 (FIG. 2) along with the continuous selvage warp yarns 14 to the compression stand 16 into the loom 18 through guide rollers 20 under a dancer roll 22 which reciprocates vertically as shown by the double headed arrow to adjust the tension on the warp yarns.

The warp yarns next pass through drop wires 24 which detect if any of the warp yarns are broken to halt the weaving operation. Then the warp yarns pass through the heddles 26 which raise and lower adjacent warp yarns or groups thereof to form the shed 25 wherethrough the fill yarns 27 are passed to form the weave.

The reed 28 is a comb-like device that separates the warp yarns and also beats each succeeding fill yarn against that already woven. The thus woven fabric then passes past the slitter means 30 which slits the fill yarns 27 between the innermost continuous selvage yarn 14 and the outermost main fabric warn yarn 12. It is preferred that in weaving, a space of from 3 to 9 mm be left between the aforementioned yarns.

The selvage is then separated over guide roller 33 from the main fabric where the main fabric is wound on wind-up roll 32 and the selvage is guided on roll 34 beneath the loom through horn guide 36 and onto spreader bar 41 which has spaced guides 42 which separate the continuous selvage warp yarns 14 to allow the fill fringe yarns 40 to be discharged from the continuous selvage warp yarns 14 with the help of shaker bar 38 which is attached to the dancer roll 22 with its up and down motion.

The continuous selvage warp yarns are then converged over rollers 44 to pass through the loom again.

While certain representative embodiments and details have been shown for the purpose of illustrating the invention, it will be apparent to those skilled in this art that various changes and modifications may be made therein without departing from the spirit or scope of the invention.

What is claimed is:

1. A method of recycling selvage warp yarns in a fabric weaving operation comprised of:

a. providing a plurality of selvage warp yarns (14) which form a continuous loop through the loom (18);

b. feeding the selvage warp yarns (14) next to an outer fabric warp yarn (12);

c. weaving fill yarns (27) through all of the warp yarns (12, 14);

d. slitting the fill yarns (27) between the outer fabric warp yarn (12) and the inner selvage warp yarn (14);

e. passing the selvage warp yarns (14) through a separator (41) to allow the cut fill yarn fringe ends (40) to dislodge from the selvage warp yarns (14); and f. recombing the selvage warp yarns (14) to feed through the loom (18) again;

wherein the method is characterized by:

after slitting the fill yarns (27) between the outer fabric warp yarn (12) and the inner selvage warp yarn (14), passing the cut fill yarns fringe ends (40) and the selvage warp yarns (14) through a shaker bar (38) to shake the cut fill fringe yarns (40) from the continuous selvage warp yarns (14).

2. The method of claim 1 wherein the outermost fabric warp yarn (14) is spaced from the innermost continuous selvage warp yarn (12) by 3 to 9 mm.

3. An apparatus for recycling the selvage warp yarns (14) in a weaving operation comprising:

a. means (44) for guiding a plurality of continuous selvage warp yarns (14) into a loom (18);

b. a loom (18) to weave the warp yarns (14) with fill yarns (27) into a fabric;

c. a slitter means (30) for slitting the fill yarns (27) between an innermost selvage warp yarn (14) and an outermost main fabric warp yarn (12);

the apparatus being characterized by:

d. guide rollers (33, 34) to direct the cut selvage portion through a horn guide (36);

e. a shaker bar (38) to shake the cut fill fringe yarns (40) from the continuous selvage warp yarns (14); and f. a spreader bar (41) having spaced guides (42) for each continuous selvage warp yarn (14) to aid in dislodging the fill fringe yarn (40).

* * * * *